US005142797A

United States Patent [19]

Cole, III

[11] Patent Number: 5,142,797

[45] Date of Patent: Sep. 1, 1992

[54] SHOE EMPLOYING NEGATIVE TOE ROCKER FOR FOOT MUSCLE INTENSIVE SPORTS

[76] Inventor: Charles D. Cole, III, 405 W. Palm, Redlands, Calif. 92373

[21] Appl. No.: 747,466

[22] Filed: Aug. 12, 1991

Related U.S. Application Data

[63] Continuation of Ser. No. 392,485, Aug. 11, 1989, abandoned.

[51] Int. Cl.[5] ..... A43B 3/00; A43B 11/00

[52] U.S. Cl. ..... 36/113; 36/102; 36/50.1

[58] Field of Search ..... 36/50, 51, 103, 88, 36/107, 113, 43, 44, 25 R, 78, 114, 71

[56] References Cited

U.S. PATENT DOCUMENTS

| | | | |
|---|---|---|---|
| 1,525,848 | 2/1925 | Bonaventure | 36/113 |
| 1,553,196 | 9/1925 | Solomonoff | 36/113 |
| 1,620,797 | 3/1927 | Bonaventure | 36/113 |
| 1,693,174 | 11/1928 | Capezio | 36/113 |
| 1,754,054 | 4/1930 | Selva | 36/113 |
| 1,813,561 | 7/1931 | Capezio | 36/113 |
| 1,844,885 | 2/1932 | Harris | 36/51 |
| 1,844,885 | 2/1932 | Harris | 36/113 |
| 2,311,996 | 2/1943 | Parker | 36/51 |
| 2,400,535 | 5/1946 | Celmer | 36/113 |
| 3,797,137 | 3/1974 | Harkness | 36/113 |
| 4,070,770 | 1/1978 | Vello | 36/43 |
| 4,199,878 | 4/1980 | Wossner | 36/113 |
| 4,413,431 | 11/1983 | Cavanagh | 36/114 |
| 4,553,342 | 11/1985 | Derderian et al. | 36/50 |
| 4,611,413 | 9/1986 | Brown | 36/43 |
| 4,716,663 | 1/1988 | Steinhauser | 36/113 |
| 4,726,126 | 2/1988 | Bernhard | 36/88 |
| 4,774,954 | 10/1988 | Ibrahim | 36/44 |
| 4,901,453 | 2/1990 | Gaynor | 36/113 |
| 4,914,837 | 4/1990 | Rieffel | 36/88 |

FOREIGN PATENT DOCUMENTS

| | | | |
|---|---|---|---|
| 2536964 | 6/1984 | France | 36/51 |

*Primary Examiner*—Steven N. Meyers
*Attorney, Agent, or Firm*—Christie, Parker & Hale

[57] ABSTRACT

A shoe employing negative toe rocker is disclosed which enhances athletic performance in sports which are foot-muscle intensive. The negative toe rocker in the shoe is induced by a structurally resilient inner sole preformed to place the sole of the shoe in a preloaded condition arcuately downward from the heel to the toe. An upper having staggered instep lacing and cutouts containing elastic web to evenly distribute and maintain the closure tension of the shoe, and heel engaging pads located on the inner surface of the medial and lateral portions of the heel of the upper constrain the foot of the wearer in the shoe. The downwardly preloaded sole provides mechanical advantage to the wearer in sports requiring significant muscle strength in the foot. Conversion of kinetic energy into potential energy by flattening of the preloaded sole and structural rigidity of the sole in static conditions transferring load from foot muscles to the stronger calf muscles enhances athletic performance.

3 Claims, 6 Drawing Sheets

SHOE EMPLOYING NEGATIVE TOE ROCKER FOR FOOT MUSCLE INTENSIVE SPORTS

This is a continuation of application Ser. No. 392,485, filed Aug. 11, 1989, now abandoned.

FIELD OF THE INVENTION

The present invention relates generally to athletic footwear. More particularly the invention provides a shoe having negative toe rocker induced by a fiber reinforced sole preloaded arcuateiy downward from the heel to the toe in combination with staggered instep lacing and heel engaging pads resulting in a shoe providing mechanical advantage to the wearer when participating in sports requiring significant muscle strength in the foot.

BACKGROUND OF THE INVENTION

Most shoes including athletic shoes employ a shape under the ball and toes of the wearer's foot which bends upward from the arch of the foot to the toe of the foot. This shape known as "positive rocker" allows the shoe to roll forward with the ball of the foot during normal walking or running motion. In most activities this is the natural motion of the foot and positive rocker provides the maximum comfort in wearing the shoe for extended periods. Wear on the sole of the shoe is also typically minimized by the positive rocker shape.

The composition and structure of the sole on many athletic shoes has been designed to provide cushioning of impact and resilience or rebound to store and release the energy absorbed by the sole during running, jumping or other similar activity.

The positive rocker of the shoe allows the sole and upper of the shoe to bend upwardly with the toes. Little or no mechanical support is provided by the shoe to assist the plantar muscles of the foot and the other flexor muscles in the lower calf of the leg which flex the toes and point the foot. If anything, the plantar muscles of the foot must work against the sole of the shoe in the direction flattening the sole which is the direction of force for launching the foot during running or walking.

High speed sprinting and high jumping or pole vaulting which are the ultimate extensions of athletic endeavors of this kind place significant strain on the muscles of the foot. The athlete employees the foot muscles as well as the muscles of the lower calf to launch the foot and as a result the leg and the remainder of the body from the ground. Normal track shoes for running or jumping provide only limited mechanical advantage. Energy absorbed in the resilient sole of most of these shoes is partially returned by the rebound of the material of the sole. However, the spring constant and length of compression are limited by the depth of the sole of the shoe. Consequently, conversion of the kinetic energy available from the foot striking the ground to potential energy stored in the sole of the shoe and then the reconversion to kinetic energy is severely limited.

Another sport requiring significant foot strength is rock climbing. The athlete engaged in a climb with a high degree of difficulty must rely on hand holds and toe holds which are very small. The toe hold is often engaged by only a very small part of the forward-most portion of the sole on the climbing boot. In a climbing boot employing positive toe rocker the boot tends to flex upwardly at the toe providing minimal support. The entire weight of the climber resting on the foot must therefore be supported by the plantar muscles of the foot and the flexor muscles for the foot located in the lower calf of the leg. The majority of these muscles are relatively small muscles in the human body and consequently are placed under great stress in this type of endeavor. Rock climbers often train with very light shoes having almost no sole called climbing slippers to strengthen the muscles required for high difficulty climbs.

The prior art approach to assisting the climber has been to stiffen the sole of the positive rocker climbing shoe to prevent the sole from bending upwardly thereby reducing somewhat the load on the climber's foot when stationary. However, in many situations the muscles in the climber's foot must not only support the climber's weight but work against the stiffened sole when the climber is extending upward for the next handhold or foothold. In addition increased stiffness in the sole reduces the amount of feeling or sensitivity the climber has in the foot to "feel" the foot hold in the rock.

Stiffening of the sole through harder materials or in mid-sole stiffeners made of metal or plastic also cause the boot to no longer conform to the foot unless the foot is in the initial position conforming to the boot. Further, since the boot is not flexible the boot will not conform to the foothold in the rock. Thereby adversely affecting the friction between the boot and the rock.

It is therefore desirable to provide a shoe which will offer a mechanical advantage to the athlete both in the form of energy conversion from kinetic to potential and back to kinetic and, in a static case, the transfer of force from the plantar muscles in the foot and flexor muscles of the calf, which control the toes, to the much larger calf muscles, the soleus and gastrocnemius which flex or point the foot as a whole.

SUMMARY OF THE INVENTION

The present invention is a shoe having a resilient sole which arches downwardly from the heel to the toe in a preloaded condition. The sole pliably resists flattening or torquing. The upper portion of the shoe which is attached to the sole is tightened across the instep by way of alternately staggered tightening means which may be laces or straps extending between medial and lateral portions of the upper. In the heel portion of the upper means for gripping the heel without unduly impinging on the achilles tendon are provided which prevent extraction of the heel from the shoe when the wearer's weight is placed on the sole of the shoe at the toes thereby tending to flatten the sole.

This combination provides for absorbing the kinetic energy in the sole due to running or jumping which causes the sole to flatten, converting the kinetic energy to potential energy which may then be returned on rebound. The muscle force from the foot of the wearer necessary to launch the foot is thereby reduced.

Similarly, in the static condition, such as for the rock climber, placing the weight on the toes thereby tending to flatten the sole from its preloaded arcuate condition provides a mechanical advantage which reduces the strain on the muscles of the foot. The heel engaging portions of the upper prevent the heel from being extracted from the shoe which would be precipitated by the downward urging of the sole in response to the flattening force on the toes.

The present invention therefore provides significant advantage for numerous athletic endeavors which may employ various embodiments of the invention in specifically designed shoes. Greater understanding of the invention may be obtained through the accompanying drawings and the subsequent detailed description.

DETAILED DESCRIPTION OF THE INVENTION

Figure 1:
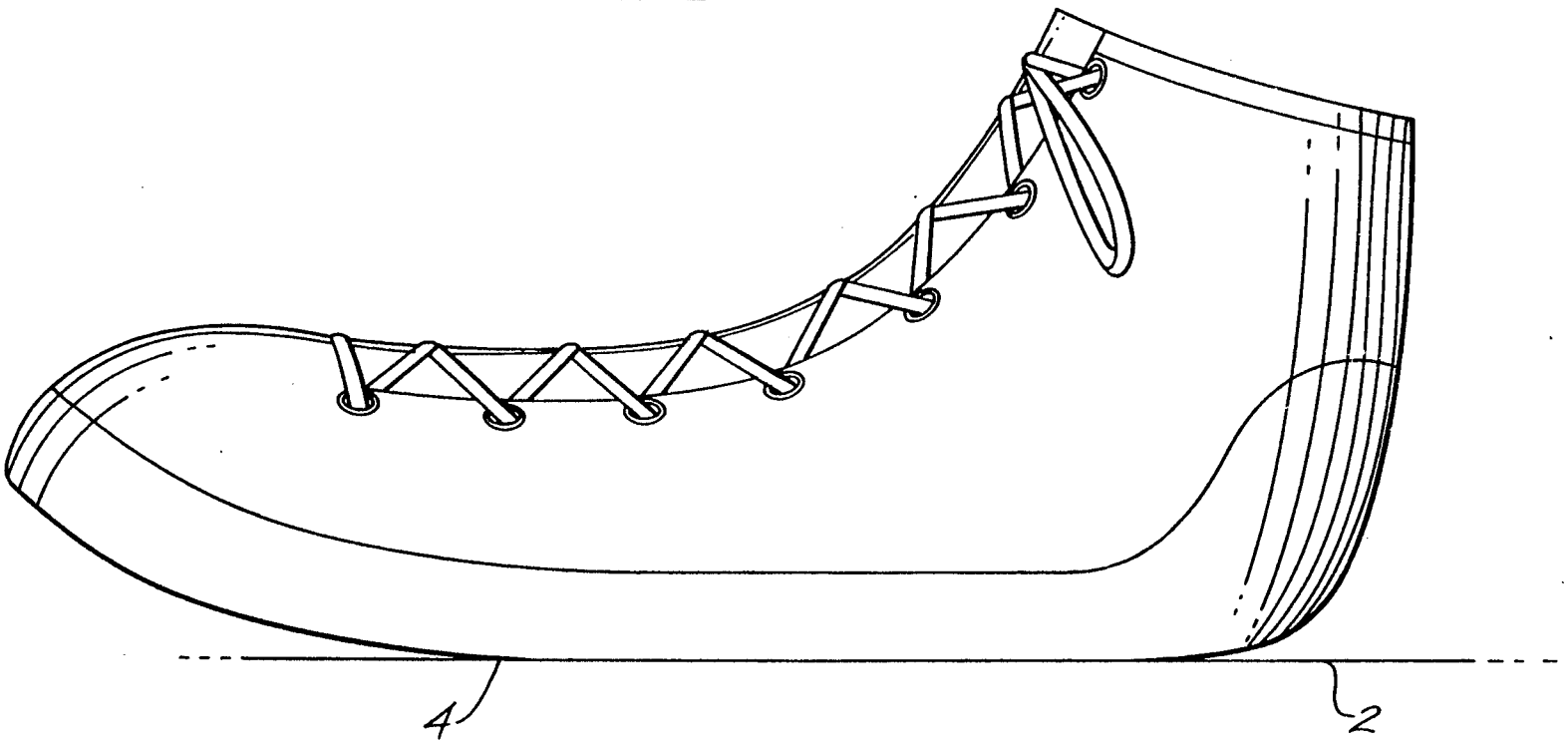
Fig. 1 PRIOR ART
FIG. 1 is a side view of a prior art shoe incorporating standard positive toe rocker.

Referring to FIG. 1 of the drawings a typical shoe known in the prior art is shown. When placed on a horizontal surface 2 the sole of the shoe 4 arches upwardly from the surface in a positive toe rocker. As with many athletic shoes including climbing boots, the sole is made of rubber or other similar material which extends up the sides toe and heel of the shoe for abrasion protection of the upper. A standard lace closure of the upper is depicted.

Figure 2:
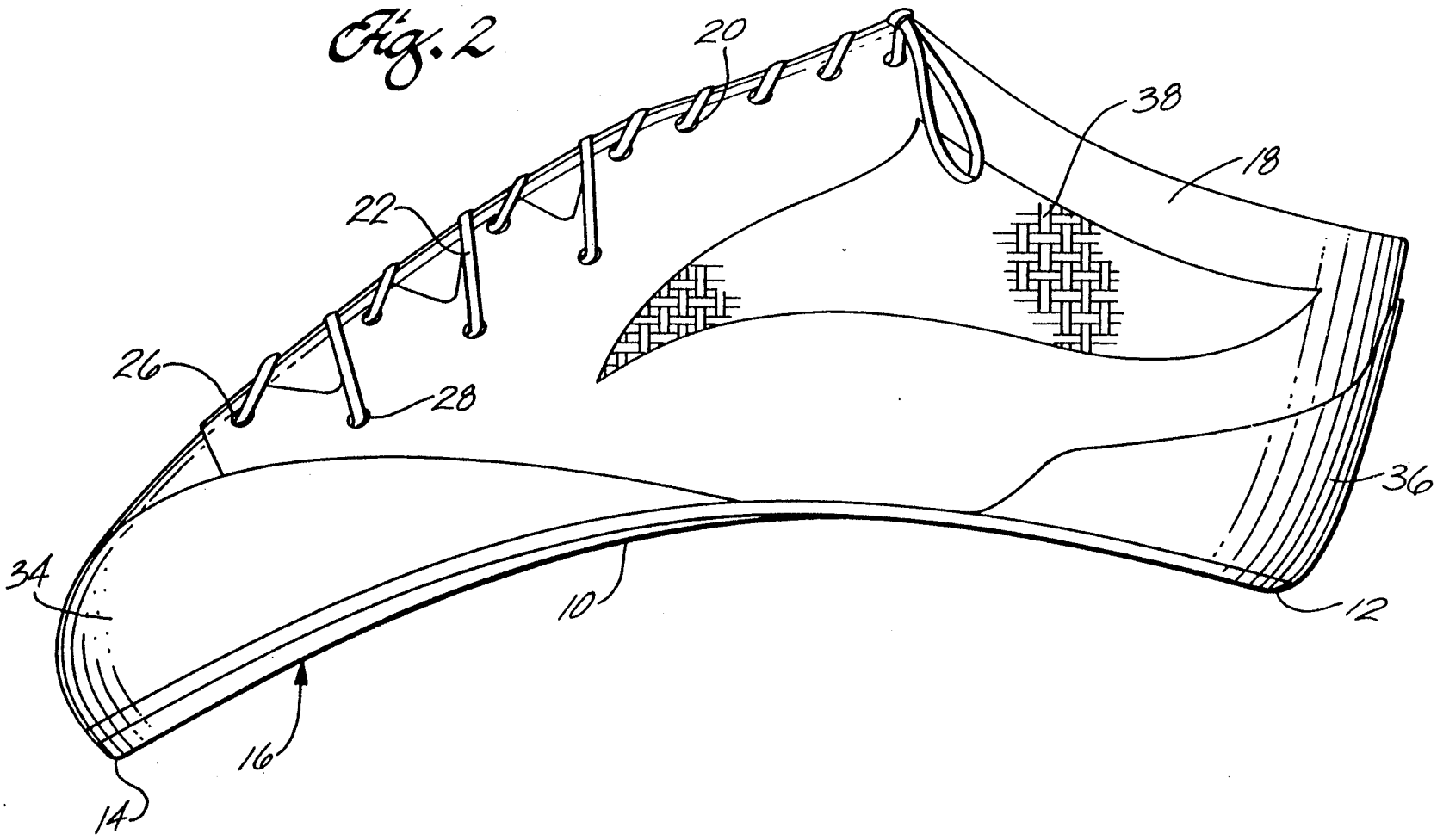
FIG. 2 is an overall lateral prospective of a shoe employing a first embodiment of the invention.

A shoe employing a first embodiment of the present invention is shown in FIG. 2. The sole 10 is downwardly arched from a heel end 12 to a toe end 14. The sole is resilient and formed in the arcuate configuration to pliably resist flattening when the wearer places the weight on the forward portion of the sole generally designated 16 between the ball of the foot and the toe end of the sole.

Figure 3:
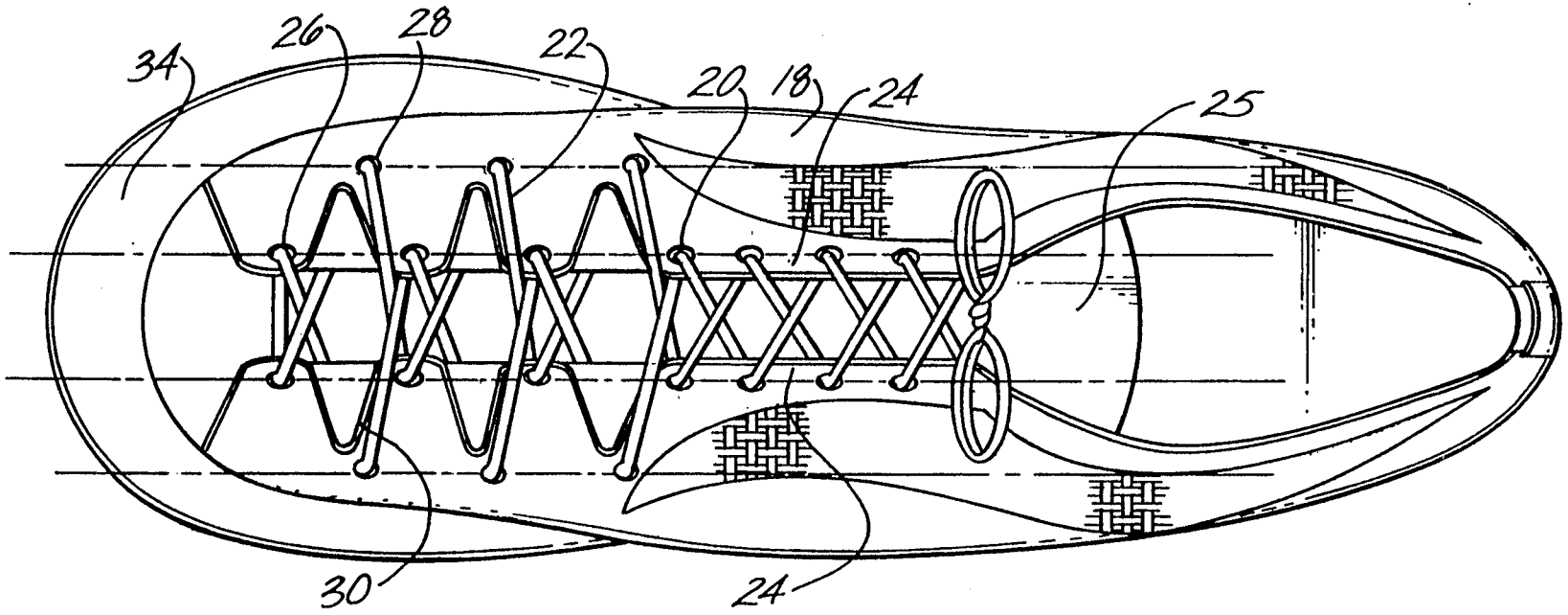
FIG. 3 is a dorsal or top view of the shoe as shown in FIG. 2.
Figure 5:
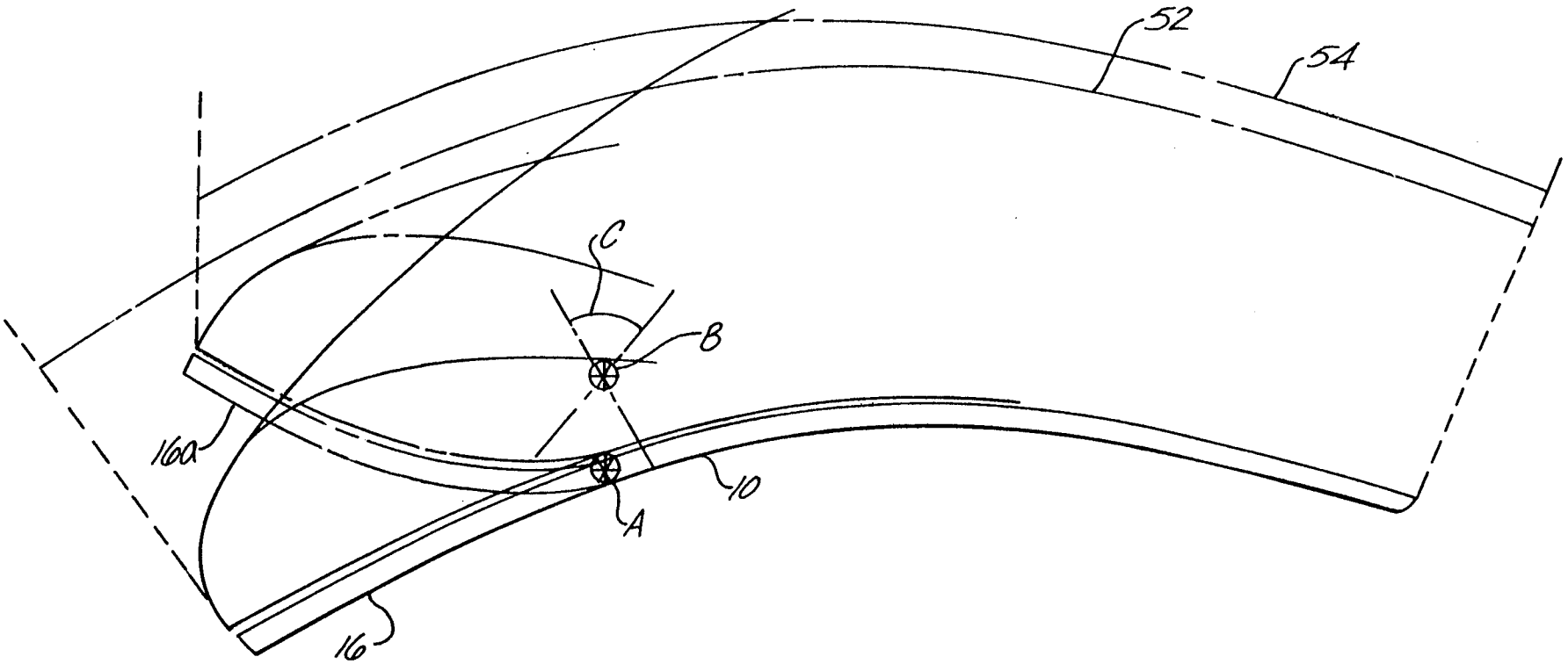
FIG. 5 is a side view demonstration of the pivot point comparison between the sole of a shoe employing the present invention and a foot inserted in the shoe.

The upper 18 of the shoe has a lace closure in the embodiment shown which comprises holes 20 in the material of the upper and laces 22. The lips 24 of the upper close over a tongue 25 to tighten the upper over the instep of the wearer. A standard padded tongue for protecting the instep of the foot may be employed. The holes are spaced oppositely on the lips of the closure and staggered alternately over the instep of the shoe in a first plurality of upper holes 26 proximate the lips of the closure and a second plurality of lower holes 28 distal the lips of the closure as best seen in FIG. 3. The lips of the closure contain cutouts 30 intermediate the upper holes which extend from the edge of the lip to a point adjacent each of the lower holes. An elastic web 32 is sewn into each cutout. The optimum extent of the alternating cutouts and upper and lower lace holes is defined by the angle subtended by rotation of the foot within the shoe. This angle designated C in FIG. 5 is at a maximum in the toe down preloaded position of the sole. Choice of the number of cutouts and corresponding upper and lower laceholes is determined based on the rigidity of the material used in the upper and the amount of sole rotation based on the original preloaded arch and the flexibility of the sole.

A rand 34 and quartercap 36 of abrasion resistant material cover the toe and quarter of the upper respectively. A vent 38 of porous mesh material is provided in one or both sides of the upper to provide for cooling of the shoe.

Figure 4:
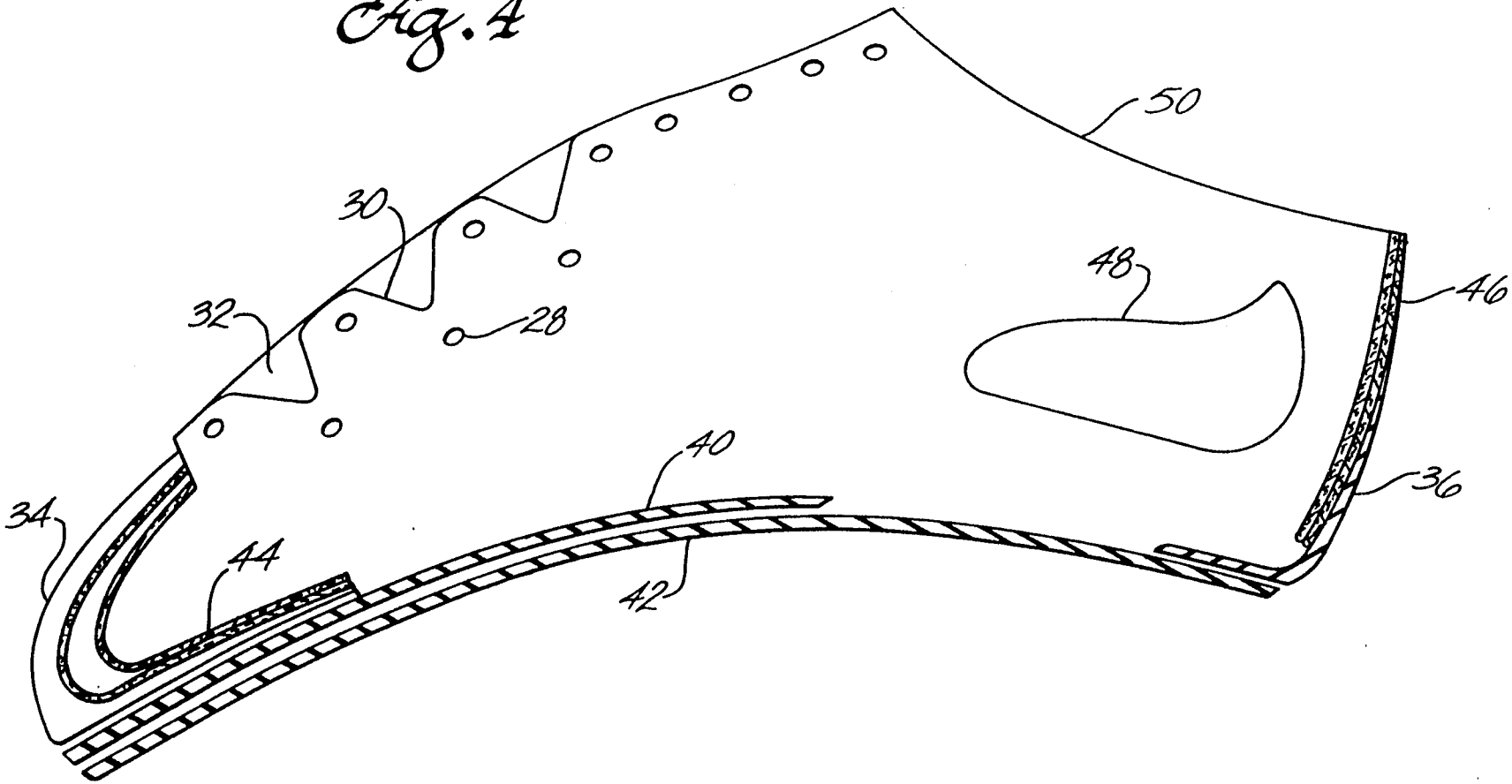
FIG. 4 is an exploded cut-away of the shoe of FIG. 2 clearly demonstrating the elements of the first embodiment shown in FIGS. 2 and 3 above.

The exploded cutaway of the shoe shown in FIG. 4 further illustrates construction of the embodiment shown. The sole of the shoe comprises an inner sole 40 preformed in the negative rocker arch to pliably resist flattening of the sole. The preformed inner sole may be fabricated from a number of materials. The inner sole must have some structural rigidity, however, remain pliable enough for the shoe sole to flatten or flex slightly. A structural plastic such as polyurethane or polyethylene molded in the arched preload configuration may be employed.

As an alternative, fiber reinforced composite materials may be used and specifically engineered to provide the desired combination of structural rigidity and pliability. The use of fiber composites also allows altering the rigidity for various bending directions of the sole. The flattening and torquing of the sole may be resisted with differing rigidity, depending on the fiber orientation and fiber type, as well as the composite matrix material. In the embodiment shown the fibers in the inner sole are arranged in a multi-directional pattern to provide fibers in tension when the sole deforms from its preloaded condition to flatten or torque. Those skilled in the art will recognize that various combinations of orientations in the fibers including 30–60, 45–45 and 0–90 with respect to an axis from toe to heel of the shoe may be employed in varying numbers to provide the desired flex of the sole. In the embodiment shown for a rock climbing shoe, carbon fibers embedded in a polyurethane, rubber or softened epoxy matrix of relatively high modulus provides the desired combination of pliability and mechanical resistance.

The inner sole may extend the full length from the toe end to the heel end of the sole or extend part way from the toe end under the arch of the foot to provide the desired mechanical support or kinetic energy absorption depending upon application. Those skilled in the art will recognize alternate materials and configurations for the composite of the inner sole such as fiberglass, kevlar or other aramid fiber with various matrix materials tailored for the particular application of the shoe.

An outer sole 42 is attached to the inner sole to provide the actual contact surface of the sole. In the embodiment shown, a material having a high coefficient of friction such as a composition rubber is employed. For specific use in rock climbing shoes Stealth, Stealth II or Stealth IV rubber (trademarks of 5.10, Redlands, Calif.) may be employed.

Various materials may be used for the construction of the upper on the shoe. Running or track shoes may employ nylon or other synthetic material, or canvass. For applications where additional durability or longevity are desired, such as the embodiment shown for rock climbing shoes, various combinations of leather may be used. As shown in FIG. 4, the upper of the embodiment shown employs an inner layer 44 of soft pigskin leather for maximum durability and comfort which is overlaid by a second layer of fine grain leather 46. The inner and outer sole, upper, rand and quarter cover may be joined by combinations of stitching and adhesive as known to those skilled in the art.

The mechanical advantage provided by the preloaded downward arch in the sole allows design flexibility in the athletic shoe for optimum performance. The downward arch preload may be accomplished through the use of an inner sole of resilient structural material and an outer sole may be provided having an impact absorption properties to dampen shock on the wearer's foot and leg or provide additional kinetic to potential energy conversion by rebound design. The use of the structural preload allows reduction in thickness of the sole. The outer sole may be optimized for impact reduction which may be accomplished in a reasonably thin layer while kinetic to potential energy conversion is accomplished in the preloaded inner sole. This eliminates the thickness typically required in a rebound type sole for absorbing and releasing energy due to foot impact.

An additional element of the invention is best seen in FIG. 4. When the wearer of the shoe places weight on the toe portion of the sole the pliable resistance of the sole to flattening results in a tendency for the heel of the wearer to pull upwardly out of the heel of the shoe. To counter this tendency, the embodiment of the invention shown in FIG. 4 provides a pad 48 which extends inwardly from both the medial and lateral sides of the upper. The pad is located and sized to be accommodated in the depression in the heel of the wearer posterior to the lateral and medial malleolus. The pad in the tightened upper in effect grips the medial and lateral process of the calcaneus or heel bone.

In many prior art athletic shoes where the rigidity of the sole tended to pull the heel of the shoe from the wearer's heel, drawstrings or elastic were placed in the cuff 50 of the shoe drawing the opening tight about the heel of the user. This approach caused the cuff of the shoe to cut into the achilles tendon placing the tendon under lateral pressure which was extremely uncomfortable for the wearer and reduced the effective strength and mobility of the achilles tendon. The present invention as shown in FIG. 4 entirely eliminates pressure on the achilles tendon and relies on the natural physiological shape of the heel to counteract the tendency of the shoe to slide down the heel.

A feature of the invention which is of particular use in a rock climbing shoe is best shown in FIG. 5. For rock climbing, in order to maintain the greatest stability, the shoe is sized to be extremely tight on the foot of the wearer. In the present invention the center of rotation for bending of the shoe is located in the sole at point A, when weight is placed on the toe portion of the shoe causing the preloaded toe portion of the sole to move from location 16 to location 16 A as shown in phantom in FIG. 5. Depiction in the drawing is exaggerated for clarity. The rotation of the sole is about point A. The rotation of the foot of the user, however, is about a point in the interior of the foot, based on the joint locations, designated point B. As a result of the upward flexing of the sole the effective size of the shoe with respect to the foot is significantly reduced. In a present embodiment of the invention employed in a rock climbing boot a reduction in size of one-half to one and one-half full sizes results. The size change is best seen in the representative lengths of arc 52 for the shoe in the preloaded toe down state and arc 54 with the preloaded toe flexed upwardly by placement of weight on the toe portion of the sole. This feature allows the shoe to fit relatively comfortably with the shoe in an "unloaded" condition. When weight is placed on a toe hold by the climber, the sole flattens and the shoe automatically tightens gripping the foot for greater stability.

Figure 6B:
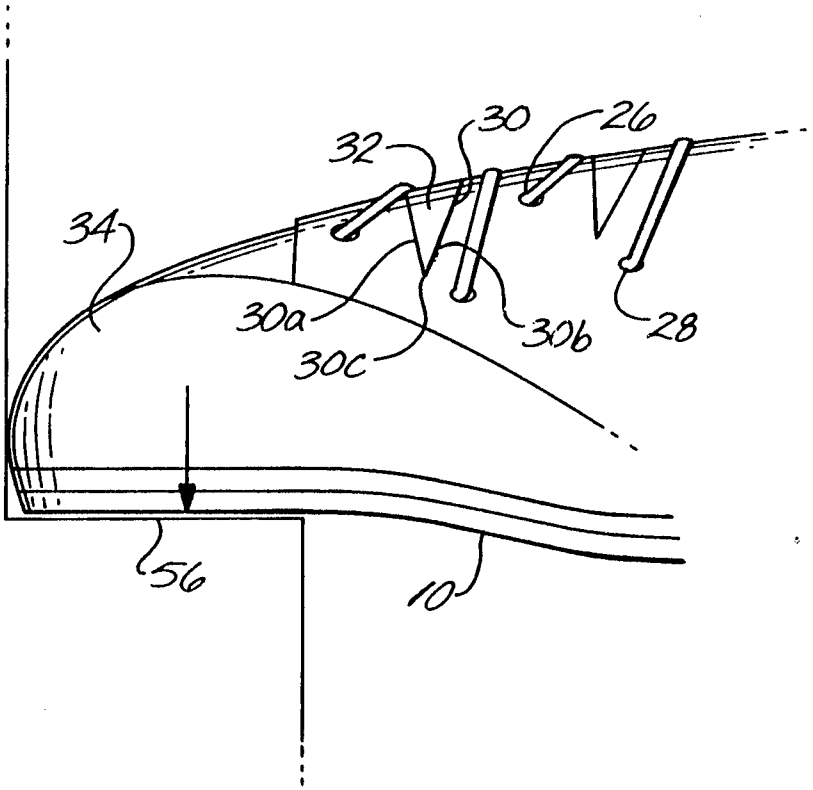
FIG. 6*b* is the resulting static configuration of the shoe after weight of the climber is placed on the foot hold.
Figure 6A:
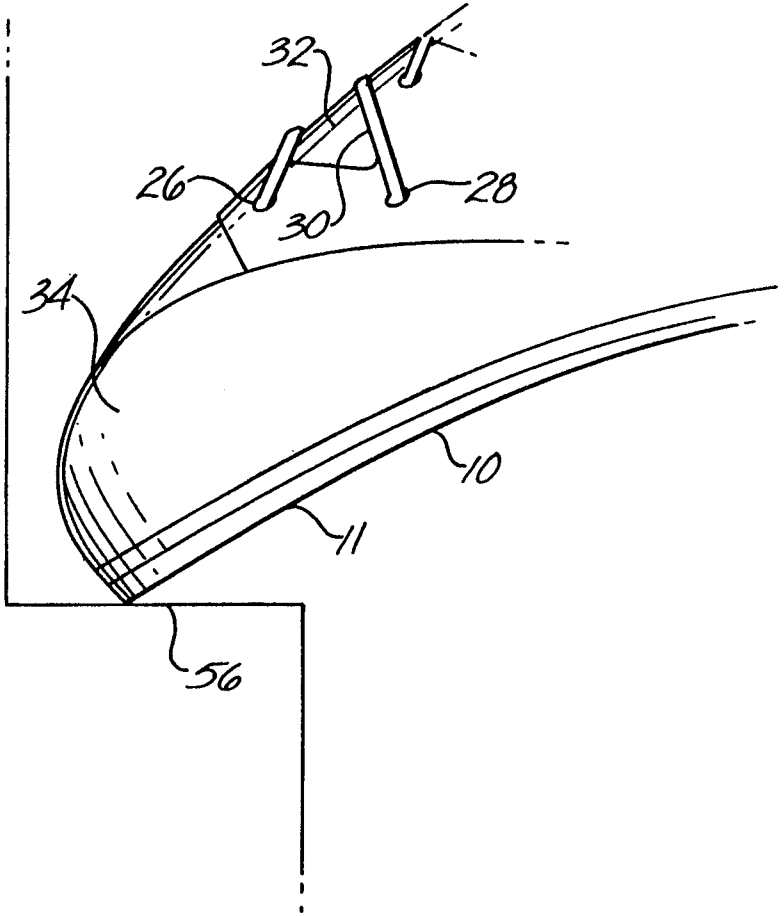
FIG. 6*a* is a side view of an embodiment of the present invention in a rock climbing shoe prior to engaging a foot hold by placing weight on the shoe.

Other features of the invention as previously described also operate to maintain the conformance of the upper of the shoe to the foot in the preloaded toe down condition and in the flexed condition with weight on the one portion of the shoe. The cutouts in the lips defining the closure in the upper previously described are drawn open with the sole in the preloaded toe down condition. Again using the example of a climbing boot this is best seen in FIG. 6*a*, which shows the climbing shoe in the unweighted toe down preload condition prior to placing the climber's weight on a toe hold 56. The elastic web in the cutout is placed in tension when the cutout is drawn open by tightening the shoe about the instep. As seen in FIG. 6*b* when the climber places weight on the forward portion of the sole on the foot hold and the sole flattens from the preloaded, toe down condition. The elastic web in the cutout contracts to maintain tension in the lips of the upper. The sides 30*a* and 30*b* of the cutouts are drawn together about the vertex 30*c* of the cutout.

The staggered lacing holes previously described contribute to maintaining uniform tension in the upper across the instep of the wearer. Tension in the laces in the alternating upper and lower holes is maintained essentially constant in both the loaded and unloaded position of the shoe. If the laceholes were colinear, as in conventional shoes, tension in the laces would vary between alternating holes causing discomfort to the wearer and possible undesirable wear of the laces. Those skilled in the art will recognize that the laces employed in the embodiment shown in the drawings may be replaced by velcro straps of alternating lengths attaching to the upper at the positions of the upper and lower laceholes or alternate similar closure techniques.

The embodiment of the invention in rock climbing shoes is particularly advantageous in that the toe down preload of the sole also provides natural positioning of the foot and toes for use as a "hook" in over-hanging rock maneuvers. The toe down shape is additionally the natural shape for "jamming" in cracks. Prior art climbing shoes or boots required that the climber fight the positive rocker of the sole to point the toe for jamming in the crack. Muscle control of the foot is somewhat degraded in the supinated position of the foot used in crack jamming which further debilitates the climber when fighting the positive rocker in prior art shoes. The present invention provides optimum natural positioning of the foot.

The present invention as described is the result of kinesiological evaluation of the mechanical advantage needed to supplement the musculature of the foot for improved athletic performance. The invention has been described in detail as required by the patent statutes and those skilled in the art will recognize modifications or alterations of the invention to meet specific needs. Such modifications and alterations are within the scope and intent of the invention as described in the following claims.

What is claimed is:

1. A shoe providing resilient support for supplementing the lantar muscle strength in a wearer's foot, the foot having toes, a ball, an instep and heel the shoe comprising:

a resilient sole downwardly arched from a heel end to a toe end, the toe end terminating proximate the extremity of the toes of the wearer's foot, the downward arch preloading the sole to resiliently resist flattening responsive to a force applied substantially perpendicular to the sole on a toe portion of the sole extending from the ball of the wearer's foot to the extremities of the toes;

an upper attached to the sole and providing means for tightening the shoe across the instep of the foot, the means for tightening having medial and lateral lips in the upper each having an opposing edge defining a closure over a tongue;

a first plurality of tensioning means proximate the edge of each lip;

a second plurality of tensioning means distal the edge of each lip alternately spaced intermediate the first plurality of tensioning means;

means for preventing wrinkling of the lips comprising a plurality of cutouts intermediate the first plurality of tensioning means and extending from the edge of each lip to a vertex proximate the alternating second plurality of tensioning means, each cutout having an elastic web fastened therein, the elastic web expanded when the shoe is in a first downwardly arched preloaded condition and contracted with the shoe is in a second flattened condition; and means for engaging the heel of the foot to prevent extracting the heel from the shoe when the wearer's weight is brought to bear on the sole of the shoe creating the force on the toe portion of the sole.

2. A shoe as defined in claim 8 wherein the first plurality of tension means comprises:

a first plurality of holes proximate the edge of each lip;

the second plurality of tensioning means comprises a second plurality of holes distal the edge of each lip; and a continuous lace extends alternately through the first and second plurality of holes.

3. A climbing shoe for providing resilient support for supplementing plantar muscle strength in a climber's foot having an instep and a heel, the shoe comprising:

an inner sole of multiply oriented structural fiber encased in a high modulus resin matrix preformed to arch downwardly from a heel end to a toe end;

an outer sole of high friction rubber attached to the inner sole;

an upper attached to the inner sole having a toe portion, an instep portion and a heel portion, the instep portion having two lips each with an opposing edge defining a closure over a tongue, each lip having a first plurality of laceholes proximate the edge, a second plurality of laceholes alternately intermediate the first plurality of laceholes distal the edge of each lip, a third plurality of cutouts extending from the edge of each lip intermediate the first plurality of laceholes, each of the cutouts terminating in a vertex proximate the second plurality of laceholes, and each cutout containing an elastic web therein;

a continuous lace inserted alternately through the first plurality of laceholes and the second plurality of laceholes for tensioning closure of the lips;

a pad extending inwardly from each of a medial and lateral side of the heel portion of the upper, the pads located to engage a medial and a lateral depression respectively in the climber's heel;

a rand of abrasion of resistant rubber covering the toe portion of the upper; and a quarter cover of abrasion resistant rubber covering the heel portion of the upper.

* * * * *

UNITED STATES PATENT AND TRADEMARK OFFICE

CERTIFICATE OF CORRECTION

PATENT NO. : 5,142,797

DATED : September 1, 1992

INVENTOR(S) : Charles D. Cole, III

It is certified that error appears in the above-identified patent and that said Letters Patent is hereby corrected as shown below:

Column 6, line 61, change "lantar" to -- plantar --.

Column 7, line 23, before "the shoe" change "with" to -- when --.

Column 7, line 29, change "claim 8" to -- claim 1 --.

Signed and Sealed this

Seventh Day of December, 1993

*Attest:*

*Attesting Officer*

Bruce Lehman

BRUCE LEHMAN

*Commissioner of Patents and Trademarks*